United States Patent [19]

Cusack

[11] Patent Number: 4,726,741

[45] Date of Patent: Feb. 23, 1988

[54] MAGNETOSTRICTIVE PUMP WITH HYDRAULIC CYLINDER

[75] Inventor: Robert F. Cusack, Grosse Pointe Park, Mich.

[73] Assignee: GTE Valeron Corporation, Troy, Mich.

[21] Appl. No.: 918,220

[22] Filed: Oct. 14, 1986

Related U.S. Application Data

[63] Continuation-in-part of Ser. No. 759,554, Jul. 26, 1985, abandoned, and Ser. No. 759,555, Jul. 26, 1985, abandoned.

[51] Int. Cl.[4] ..... F04B 17/00; F04B 35/00

[52] U.S. Cl. ..... 417/322; 417/410; 417/505; 310/26

[58] Field of Search ..... 417/322, 410, 417, 505; 310/26; 251/65; 60/545, 583

[56] References Cited

U.S. PATENT DOCUMENTS

| | | | |
|---|---|---|---|
| 1,092,453 | 4/1914 | Rainey | 310/26 |
| 2,772,862 | 12/1956 | Van Suchtelin | 310/26 |
| 2,776,417 | 1/1957 | Harris | 310/26 |
| 2,842,067 | 7/1958 | Stevens | 310/26 |
| 3,175,132 | 3/1965 | Salter | 310/26 |
| 3,194,162 | 7/1965 | Williams | 417/322 |
| 3,349,304 | 10/1967 | Wachter | 310/26 |
| 3,391,680 | 7/1968 | Benson | 417/322 |
| 4,096,735 | 6/1978 | Huntzinger et al. | 310/26 |

*Primary Examiner*—Carlton R. Croyle
*Assistant Examiner*—Donald E. Stout
*Attorney, Agent, or Firm*—David J. Koris

[57] ABSTRACT

A magnetostrictive hydraulic pump having a pump cylinder closed at one end with an elongated piston arranged within the cylinder from the other end. The piston is constructed of a magneto-strictive material which increases in length in the presence of a magnetic field of appropriate intensity. It is wound along its length with a coil of wire capable of producing an electromagnetic field upon energization. The piston is fastened at the open end of the cylinder to define a cylinder cavity between the cylinder closed end and the piston. A pair of passages, including valves, lead to a differential hydraulic actuator, for use as an intake and an exhaust passage to the actuator. The valve members in each cavity comprise a magnetically polarized member, each end of opposed polarity, such that upon energization of the pump with one polarity of pulses, the valves will assume a particular function, and with a reversed polarity of operating pulses, a reverse function. The volume of this cavity is reduced when the piston expands under the influence of the magnetic field created by the coil to produce a pressure on any fluid contained within said cavity to force it out the exhaust passage to activate the hydraulic cylinder. In a preferred embodiment the cylinder is constructed of a negative magneto-strictive material which contracts or shrinks in length in the presence of magnetic field.

16 Claims, 2 Drawing Figures

MAGNETOSTRICTIVE PUMP WITH HYDRAULIC CYLINDER

CROSS REFERENCES TO RELATED APPLICATIONS

This invention is a continuation-in-Part of U.S. copending patent applications Ser. Nos. 759,554 and 759,555 claiming priority on the respective filing date of July 26, 1985, both now abandoned.

This application is related to the following copending applications of applicant filed at the same time and assigned to the same assignee:

Negative Magnetostrictive Pump, Ser. No. 905,006

Magnetostrictive Pump with Hydraulic Pump with Reversible Valves, Serial No. 905,007

Magnetostrictive Hydraulic Injector, Ser. No. 904,447

FIELD OF THE INVENTION

This invention relates to a precision stepper as used in numerical control machines and utilizes a fluid pump and hydraulic cylinder. More particularly, it includes a reciprocating piston pump wherein the piston is reciprocated magneto-strictively and the valves are conditioned by the polarity of the pulses used to operate the pump.

BACKGROUND OF THE INVENTION

It is known in the present state of the art to provide magnetically actuated pumps wherein an electromagnet is used to reciprocate a piston or flexible diaphram through suitable linkage to provide the required volumetric displacement. These types of pumps however do not readily adapt themselves to applications where they are required to produce measured amounts of fluid at high pressures and where the output must be bidirectional.

It is also known that certain metals when placed in a magnetic field react by changing their dimensions. This effect is known as magneto-striction. A more thorough discussion of this phenomenon may be found in the book authored by Richard M. Bozorth entitle "Ferro-Magnetism" and published by the D. Van Nostrand Co. Inc. (Sept. 1968).

Further it is also known to use mechanically activated incremental tool steppers such as by planetary gear reducers operated by reversible motors of rachet type linear steppers.

However none of these devices readily lend themselves to the requirements impassed by the higher degree of automation and computer control now being applied in industry.

SUMMARY OF THE INVENTION

Accordingly, it is an object of the present invention to produce a unitary hydraulic pump and tool actuator capable of producing a pressure utilizing the magnetostrictive effect to move the actuator.

It is another object of the present invention to produce a unitary pump and actuator, the direction of the output of which can be reversed to control the direction of movement of the actuator.

It is a further object of the present invention that the unitary pump output a constant volume displacement for each operation to move the actuator a fixed predictable distance.

It is yet a further object of the present invention to utilize both positive expansive and negative contractive magnetostrictive qualities in a single application.

These and other objects and features of the present invention are accomplished in a simple cylindrical pup including a piston of magneto-strictive metal wrapped in an electro magnet and fastened at one end to the cylinder, with the other end free within the cylinder to move axially. The cylinder is closed at the end facing the pistons free end to enclose the pump cylinder cavity. By the provision of a pair of passages that can selectively perform as an intake or an exhaust passage and valve arrangement to communicating with said cavity to a differential hydraulic actuator cylinder, the piston ends reciprocating motion results in a pump action governed by the strength of the magnetic field created by the coil and the constants of the metal used to make the piston. The selective use of the passages is accomplished by including a permanent magnet in each valve member positioned with opposing poles at the common ends, such that a particular polarity of direct current used to operate the pump will cause the output to pass in one direction and move the actuator in a particular direction, and the opposite polarity of direct current will cause the output to pass in the opposite direction and correspondingly move the actuator in an opposite direction.

In the present example the cylinder is also constructed of a magneto strictive material having a negative magnetostrictive quality.

BRIEF DESCRIPTION OF THE DRAWING

For a more complete understanding of the invention, reference may be had to the following detailed description of the invention in conjunction with the drawing wherein.

DESCRIPTION OF THE PREFERRED EMBODIMENT

Figure 1:
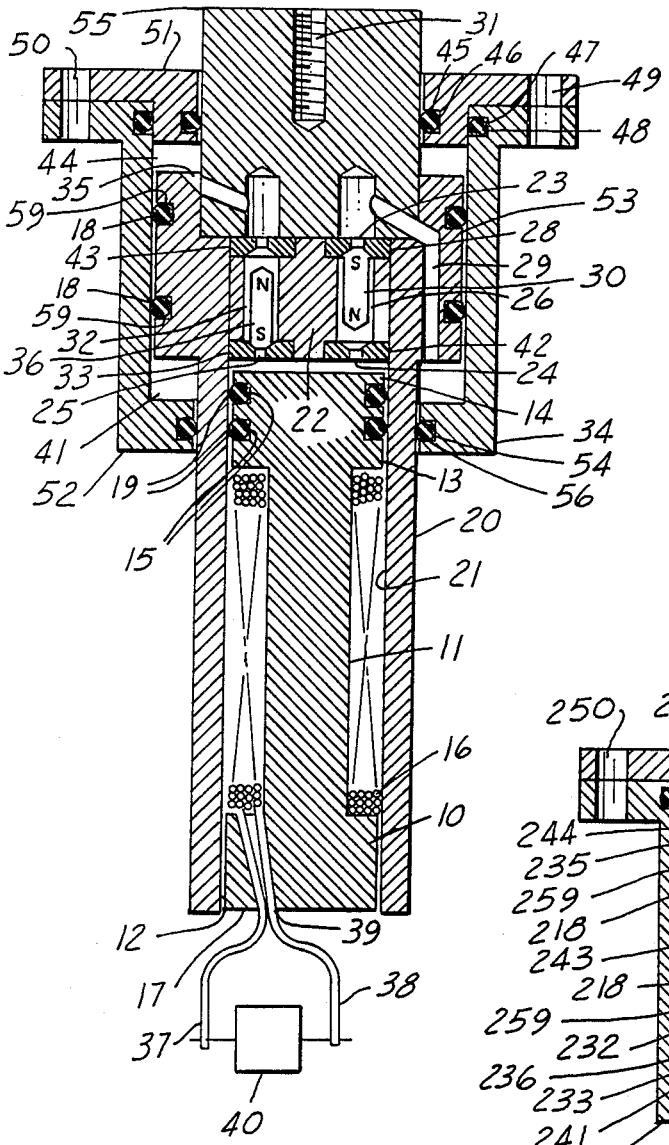
FIG. 1 illustrates in a sectional view the structure of the novel pump and actuator assembly having an electro-magnetic coil wound about the piston.

The novel hydraulic pump of the present invention as shown in FIG. 1 consists of a cylindrical pump housing 20 with a coaxial pump piston 10 within it. The pump cylinder 20 is shown as made of a solid metal but in this preferred embodiment it would be laminated to enhance its performance at higher frequencies of operation. The pump piston should also be laminated or assembled of rods for the same reasons. The pump piston 10 is fastened at its base and 17 to the cylinder's inner surface 21 at housing interface 12. The pump piston somewhat resembles a spool in that it is axially recessed 11 along its outer surface to receive a magnetizing coil 16 wound around it as a core. The coil terminals 37 and 38 are taken out via a passage 39 and may be connected to an energizing and control source shown at box 40. The unrecessed ends, of the pump piston, the base end 17 and the piston face end 13 contain the coil as spool ends. The piston face end 13 as shown has two circumferential grooves 15 dimensioned to receive a pair of piston ring seals 19.

Figure 2:
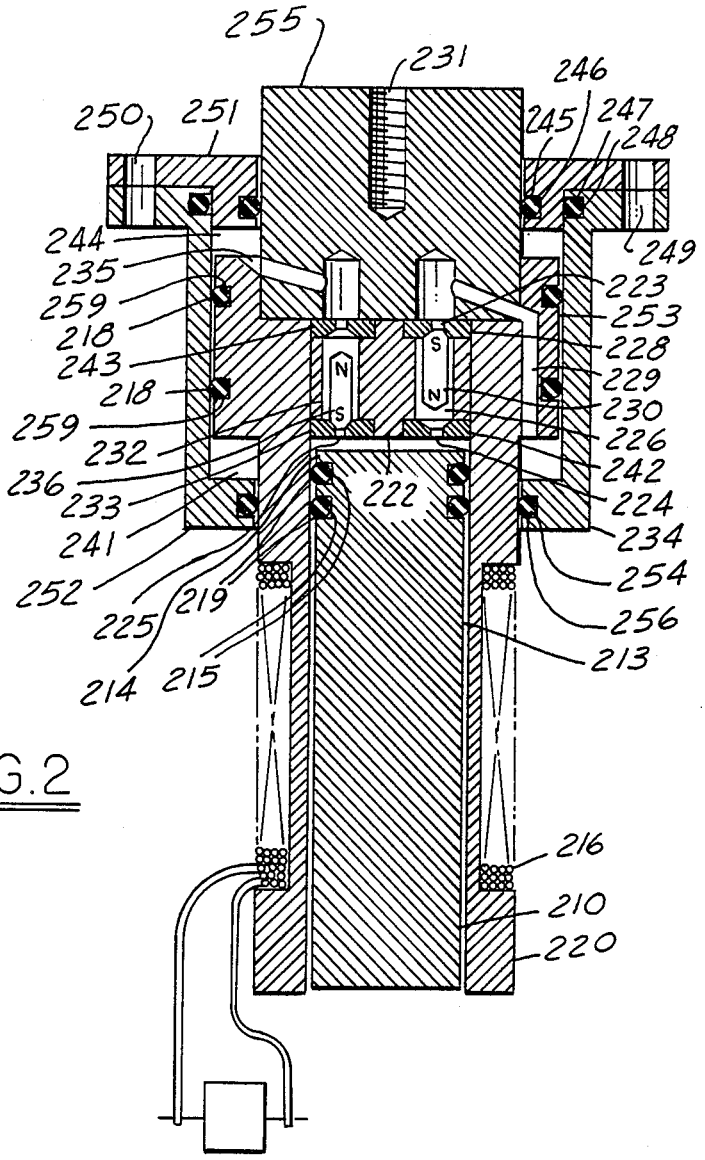
FIG. 2 illustrates in a sectional view the structure of the novel pump and actuator assembly having an electro-magnetic coil wound around the exterior of the pump cylinder.

In an alternate embodiment as shown in FIG. 2 the pump piston 210 does not have an axial recess for the magnetizing coil. The magnetizing coil 216 is wound around the exterior of the pump cylinder 220. This arrangement is preferred for applications where it is required that the assembly be free to rotate axially. In such an application the pump cylinder 220 would be constructed of a non-magnetic material to obviate the possibility of the flux being shunted away from the piston. In other respects the pumps would be similar and corresponding components are labelled with the same numeral prefixed with a 2.

Returning to FIG. 1, the pump cylinder 20 further includes a cylinder head portion 22 suitably fastened to the cylinder's inner surface 21 at the interface 23. Within the cylinder head 22 are located a pair of hydraulic passages 29 and 35, each including a valve chamber 26 and 32 with a valve assembly therein.

Each valve assembly includes a pair of magnetic valve seats 28 and 33 and a pair of magnetic valve seats 42 and 43; positioned at the interior and exterior ends of valve chambers 26 and 32 and double ended shuttle valve members 30 and 36. These valve members are arranged to seat in either of the two valve seats available to them. Another unique feature of these members is that they include or may be made of a permanently magnetizeable material. This material is magnetized as a small bar magnet with its southerly magnetic poles at the ends facing the magnetic valve seats. The shuttle members 30 and 36 are positioned in their respective valve chambers 26 and 32 so that they have opposite magnetic poles facing in a common direction. That is, as illustrated, the shuttle valve 36 in valve chamber 32 has its south magnetic pole positioned toward the magnetic interior valve seat 33, and its north magnetic pole positioned toward the magnetic exterior valve seat 43. The shuttle valve 30 in valve chamber 26 has its north magnetic pole positioned toward the corresponding magnetic interior valve seat 42 and its south magnetic pole positioned toward its magnetic exterior valve seat 28. Thus when these valve shuttles are subjected to a magnetic field generated from piston head 14, they will move in a direction opposite to sources of like polarity and each other and seat in the respective valve seats 33 and 28. Should the polarity of the energizing pulses be reversed the valve acting as an intake valve would then act as an exhaust valve and the valve acting as an exhaust valve would act as an intake valve. The valve arrangement as shown however, is only by way of example for other suitable valve types may be used.

The hydraulic passages 29 and 35 beyond the valve seats 28 and 43 lead to a pair of ring shaped hydraulic chambers 41 and 44 respectively. These hydraulic chambers 41 and 44 are the chambers of the differential hydraulic actuating mechanism consisting of the central fixed actuator piston 53 between the hydraulic chambers 41 and 44 and the axially movable actuator cylinder 34. The piston 53 comprises a collar surrounding the extension of the pump cylinder 20 and includes grooves 59 for seals 18. In one embodiment actuator piston 53 is fixedly attached to pump cylinder 20. The actuator cylinder 34 is shown as having a member 52 completing the enclosure of hydraulic chamber 41 and a ring shaped cylinder cap member 51 completing the enclosure of hydraulic chamber 44. Each of these members include a recess 45 and 54 respectively in the interior edge abutting the cylinder for seal members 46 and 56. A seal 48 is also included in cavity 47 between the actuator cylinder 34 and the cylinder cap member 51. The cylinder cap member 51 is shown as having holes 49 and 50 for fasteners which could be used to fasten the assembly to a machine tool mounting surface but are not shown in the illustration. The extension of the end cap enclosing member 55 also includes a provision for fastening a tool arrangement to it, here shown as a threaded hole 31.

As may be evident from the figure, upon a flow of fluid from the pump via passage 35 into the chamber 44, the fluid pressure will move the actuator cylinder 24 axially away from the actuator piston 53, to in effect draw in any tool affixed to end cap 55. The fluid pumped into hydraulic chamber 44 is withdrawn from chamber 41 via passage 29 by the pump. thus it is seen that no separate reservoir of hydraulic fluid is required in this completely self container pump and actuator assembly. To advance the end cap member 55, the flow of hydraulic fluid has merely to be reversed. This is readily accomplished in the instant assembly by merely reversing the polarity of the pulses used to actuate the pump causing the valves to reverse their functions from an intake to an output valve and inversely for the other valve.

The pump piston 10 is constructed of a material that has the property of expanding in the direction of an applied magnetic field. An alloy consisting of 49% Cobalt, 49% Iron and 2% Vanadium more generally known as 2V Permadur is a material that has such a property and provides a displacement of 60 micro inches per inch of length. In another embodiment the cylinder is also constructed of a magnetostrictive material having a negative characteristic which contracts in a magnetic field. The metal nickel has such a property. It provides a displacement of 35 micro inches per inch of length with a magnetic field of 250 H. The particular selections of a magneto-strictive material having expansive qualities for the pump piston and a material having contracting qualities for the pump cylinder is only by way of example, since inversely the pump piston may be constructed of a material having contractive qualities and the pump cylinder of a material having expansive qualities and still result in a pumping action having the resultant combined movement.

In operation, the magnetic field is supplied by the coil 16. The magnetic field generated thereby destabilizes the magnetic attraction between the south magnetic pole of shuttle 36 and magnetic valve seat 33 and drives the south magnetic pole of shuttle 30 into the magnetic valve seat 28 of valve chamber 26 preventing fluid passage. The piston 10 expands, and in the embodiment the pump cylinder contracts lengthwise in the direction of magnetization to displace any fluid contained between the piston face 14 and the cylinder head surface 23 forcing the fluid out through the fluid passage 25.

Upon cessation of the current flow through coil 16, the magnetic field within the coil collapses and the pump piston 10 responds by shrinking to its initial length. If the embodiment is utilized, the pump cylinder reacts by expanding back in size, to its initial length. This action reduces the pressure within the pump cylinder, drawing in additional fluid from hydraulic passage 29 past the shuttle valve 30 and valve seat 28 in valve chamber 26. This cycle of operation can then be repeated any number of times as required to move the desired amount of fluid. This pump readily lends itself to step or digital control, in that a measured amount of fluid is passed for each applied pulse thus, it is readily adaptable as a prime source for incremental tool control.

While only a few embodiments of the present invention have been shown, it will be obvious to those skilled in the art that numerous modifications may be made without departing from the spirit of the present invention which should be limited only by the scope of the claims appended hereto.

What is claimed is:

1. An integral fluid pump and actuator assembly comprising: a pump cylinder housing having a first and a second end, an elongate piston of a length shorter than said cylinder and having a first and second end, said pump piston formed of a positive magnetostrictive material, said first end of said pump piston secured to said first end of said pump cylinder, an actuator comprising an actuator cylinder, an actuator piston dividing said actuator cylinder into first and second hydraulic chambers, hydraulic fluid means in each said chamber, a cylinder head portion secured to said pump cylinder second end and having a first passage connecting to said first hydraulic chamber and a second passage connecting to said second hydraulic chamber of said actuator cylinder, each said passage including a valve chamber having magnetic valve seats, valve members located in each of said valve chambers, said valve members including permanent magnet means, said magnet means positioned in said valve members such that the comparable ends of said valves have opposite magnetic poles, and a means to interruptedly apply a magnetic field to said assembly of a first polarity, said pump piston operated responsive to said magnetic field to expand and expel any fluid located between said pump piston and head via said first passage into said first hydraulic chamber to move said actuator cylinder in a first direction.

2. An integral fluid pump actuator assembly as claimed in claim 1 wherein said pump piston contracts to its original length upon collapse of said magnetic field to draw in said fluid via said second passage from said second hydraulic chamber of said actuator cylinder.

3. An integral fluid pump actuator assembly as claimed in claim 1 wherein said pump cylinder is operated responsive to said magnetic field to contract and expel any fluid located between said pump piston and head via said first passage into said first hydraulic chamber to said actuator cylinder in a first direction.

4. An integral fluid pump and actuator assembly as claimed in claim 1 wherein said pump piston includes a circumferentially depressed section between its ends and said means to interruptedly apply a magnetic field comprises a magnetic coil located in said depressed section.

5. An integral fluid pump actuator assembly as claimed in claim 1 wherein said pump cylinder expands to its original length upon collapse of said magnetic field to draw in said fluid via said second passage from said second hydraulic chamber of said actuator cylinder.

6. An integral fluid pump and actuator assembly, as claimed in claim 1 wherein said cylinder is formed of a nonmagnetic material.

7. An integral fluid pump and actuator assembly as claimed in claim 6 wherein said means to interruptedly apply a magnetic field comprises a magnetic coil wound around the exterior of pump cylinder.

8. An integral fluid pump and actuator assembly as claimed in claim 1 wherein said pump piston is formed of an alloy consisting of 49% Cobalt, 49% Iron and 2% Vanadium.

9. An integral fluid pump and actuator assembly as claimed in claim 1 wherein said pump cylinder is formed of nickel.

10. An integral fluid pump and actuator assembly as claimed in claim 7 wherein said pump cylinder is formed of nickel.

11. An integral fluid pump and actuator assembly as claimed in claim 1 wherein said means to interruptedly apply a magnetic field to said assembly is operated to apply a magnetic field of a second polarity.

12. An integral fluid pump and actuator assembly as claimed in claim 10 wherein said pump piston is operated responsive to said magnetic field to expand and expel any fluid located between said pump piston and head via said second passage into said second hydraulic chambers to move said actuator piston in a second direction.

13. An integral fluid pump and actuator assembly as claimed in claim 10 wherein said pump piston contracts to its original length upon collapse of said magnetic field to draw in said fluid via said first passage from said first hydraulic chamber of said actuator cylinder.

14. An integral fluid pump and actuator assembly as claimed in claim 11 wherein said pump piston and cylinder are operated responsive to said magnetic field to expand and expel any fluid located between said piston and head via an outlet passage into said second chamber to move said actuator piston in a second direction.

15. An integral fluid pump and actuator assembly as claimed in claim 12 wherein said piston contracts and said cylinder expands to its original length upon collapse of said magnetic field to draw in said fluid via said first passage from said first hydraulic chamber of said actuator cylinder.

16. An integral fluid pump and actuator as claimed in claim 1 wherein said actuator piston is affixed to said pump cylinder and said actuator cylinder is axially moveable thereover.

* * * * *